US009428854B2

(12) United States Patent
Dunn et al.

(10) Patent No.: US 9,428,854 B2
(45) Date of Patent: Aug. 30, 2016

(54) METHOD AND APPARATUS FOR BALANCING AN UNBALANCED LOAD IN A WASHING MACHINE

(75) Inventors: David Scott Dunn, Smithfield, KY (US); Steven Keith Root, Buckner, KY (US); Robert Anthony Saling, Mammoth Cave, KY (US); Steven Chadwick Koepke, Pendleton, KY (US); Andres Guillermo Ruiz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1020 days.

(21) Appl. No.: 12/847,765

(22) Filed: Jul. 30, 2010

(65) Prior Publication Data

US 2012/0024016 A1 Feb. 2, 2012

(51) Int. Cl.

| | |
|---|---|
| ***D06F 35/00*** | (2006.01) |
| ***D06F 33/02*** | (2006.01) |
| ***D06F 37/20*** | (2006.01) |
| *D06F 58/28* | (2006.01) |

(52) U.S. Cl.

CPC ..... *D06F 33/02* (2013.01); *D06F 35/007* (2013.01); *D06F 37/203* (2013.01); *D06F 2058/2861* (2013.01); *D06F 2204/065* (2013.01); *D06F 2204/084* (2013.01); *D06F 2204/086* (2013.01)

(58) Field of Classification Search

CPC ..... D06F 2058/2861; D06F 39/002; D06F 39/003; D06F 37/203; D06F 35/007; D06F 33/02

USPC ..... 68/12.02, 12.06, 23.1; 8/147, 158–159

See application file for complete search history.

(56) References Cited

U.S. PATENT DOCUMENTS

| | | | | |
|---|---|---|---|---|
| 3,636,734 | A | | 1/1972 | Getz |
| 3,803,881 | A | | 4/1974 | Getz et al. |
| 4,411,664 | A | * | 10/1983 | Rickard et al. ..... 8/158 |
| 4,991,247 | A | | 2/1991 | Castwall et al. |
| 5,301,522 | A | * | 4/1994 | Ikemizu et al. ..... 68/12.06 |
| 5,325,677 | A | * | 7/1994 | Payne et al. ..... 68/12.04 |
| 5,345,792 | A | | 9/1994 | Farrington et al. |
| 5,857,360 | A | | 1/1999 | Kim et al. |
| 5,906,756 | A | | 5/1999 | Lee et al. |
| 6,032,494 | A | * | 3/2000 | Tanigawa et al. ..... 68/12.06 |
| 6,047,428 | A | | 4/2000 | Min et al. |
| 6,240,586 | B1 | | 6/2001 | Joo |
| 6,282,965 | B1 | | 9/2001 | French et al. |
| 6,393,918 | B2 | | 5/2002 | French et al. |

(Continued)

FOREIGN PATENT DOCUMENTS

| | | |
|---|---|---|
| EP | 0607678 A1 | 7/1994 |
| EP | 0678616 A2 | 10/1995 |

(Continued)

*Primary Examiner* — Michael Barr
*Assistant Examiner* — Kevin G Lee
(74) *Attorney, Agent, or Firm* — Dority & Manning, P.A.

(57) ABSTRACT

A washing machine including a suspension system is provided. The suspension system includes a wash tub, a basket rotatably coupled within the wash tub, and a drive and motor assembly. The washing machine further includes a controller configured initiate a spin cycle by increasing a spin speed of the basket to a target spin speed, identify an out-of-balance load prior to reaching the target spin speed, and limit the spin speed of the basket to a spin speed lower than a natural frequency of the suspension system for a predefined period of time.

10 Claims, 5 Drawing Sheets

(56) References Cited

U.S. PATENT DOCUMENTS

| | | | | |
|---|---|---|---|---|
| 6,422,047 | B1 | 7/2002 | Magilton | |
| 6,530,100 | B2 * | 3/2003 | Conrath | 8/159 |
| 6,594,841 | B2 | 7/2003 | Broker et al. | |
| 7,039,976 | B2 * | 5/2006 | Sears | 8/159 |
| 7,707,672 | B2 * | 5/2010 | Seo et al. | 8/159 |
| 7,788,755 | B2 * | 9/2010 | Lee et al. | 8/158 |
| 2003/0056302 | A1 | 3/2003 | Broker et al. | |
| 2003/0145392 | A1 * | 8/2003 | Hird | 8/159 |
| 2005/0000033 | A1 * | 1/2005 | Park et al. | 8/159 |
| 2005/0251926 | A1 * | 11/2005 | Lee et al. | 8/158 |
| 2006/0016021 | A1 * | 1/2006 | Kim | 8/158 |
| 2007/0039106 | A1 | 2/2007 | Stansel et al. | |
| 2007/0050918 | A1 * | 3/2007 | Kim et al. | 8/158 |
| 2008/0066238 | A1 * | 3/2008 | Lee et al. | 8/159 |
| 2009/0183319 | A1 * | 7/2009 | Chai et al. | 8/159 |
| 2009/0249560 | A1 * | 10/2009 | Gaulter et al. | 8/158 |
| 2012/0151686 | A1 * | 6/2012 | Jang et al. | 8/137 |
| 2012/0151692 | A1 * | 6/2012 | Jang | D06F 5/007 8/137 |

FOREIGN PATENT DOCUMENTS

| | | | |
|---|---|---|---|
| EP | 0732436 | A1 | 9/1996 |
| EP | 0806516 | A1 | 11/1997 |
| EP | 0969133 | A1 | 1/2000 |
| EP | 1693498 | | 8/2005 |
| JP | 10192586 | A | 7/1998 |
| JP | 2000024378 | A1 | 1/2000 |
| JP | 2000279685 | A | 10/2000 |
| WO | WO 2008053002 | A2 * | 5/2008 |
| WO | 2008023997 | A1 | 2/2010 |

* cited by examiner

METHOD AND APPARATUS FOR BALANCING AN UNBALANCED LOAD IN A WASHING MACHINE

BACKGROUND OF THE INVENTION

1. Field of the Invention

The field of the invention relates generally to washing machines, and, more particularly, to methods and apparatus for balancing an unbalanced load in a washing machine.

2. Description of the Related Art

Washing machines typically include a cabinet that houses a wash tub for containing wash and rinse water, a perforated clothes basket within the wash tub, and an agitator within the basket. A drive and motor assembly is mounted underneath the wash tub to rotate the clothes basket and the agitator relative to one another.

Washing machines utilize the basket to hold a load of articles that can be evenly or unevenly distributed. Having a load unevenly distributed, or out-of-balance ("OOB"), creates a situation where a center of mass of the rotating basket does not correspond to a rotational axis of the basket. In a typical washing machine (such as a top or front-loading washing machine) an OOB condition can occur during a spin cycle, for example, when articles to be cleansed, such as clothing and the like, bunch up asymmetrically at various locations in the basket. For various detrimental reasons, the OOB condition is not desirable if left uninterrupted. For example, a wash tub which encloses the basket may strike the cabinet of the washing machine and thus cause damage either to the wash tub, the cabinet, or both. Further, unacceptable stress forces can develop during the OOB condition that can affect a suspension mechanism of the washing machine as well as other components thereof, such as a transmission or other suitable connecting device which links the motor of the washing machine to the basket that is spinning.

BRIEF DESCRIPTION OF THE INVENTION

In one aspect, a washing machine including a suspension system is provided. The suspension system includes a wash tub, a basket rotatably coupled within the wash tub, and a drive and motor assembly. The washing machine further includes a controller configured initiate a spin cycle by increasing a spin speed of the basket to a target spin speed, identify an out-of-balance load prior to reaching the target spin speed, and limit the spin speed of the basket to a spin speed lower than a natural frequency of the suspension system for a predefined period of time.

In another aspect, a controller configured to balance an unbalanced load in a washing machine including a suspension system is provided. The controller including an interface module for receiving data from sensing mechanism configured to detect an unbalanced load in the washing machine, a memory area for storing redistribution data and user defined settings, and a processor programmed. The processor is programmed to initiate a spin cycle by increasing a spin speed of a basket in the washing machine to a target spin speed, identify an out-of-balance load prior to reaching the target spin speed, and limit the spin speed of the basket to a spin speed lower than a natural frequency of the suspension system for a predefined period of time.

In yet another aspect, one or more computer-readable media having computer-executable components is provided. The components including an interface component that when executed by at least one processor, causes the at least one processor to receive an identification that an unbalanced load in a washing machine has been detected during a spin cycle, prior to a spin speed of a basket in the washing machine reaching a target spin speed, and a redistribution component that when executed by at least one processor, causes the at least one processor to limit the spin speed of the basket to a spin speed lower than a natural frequency of a suspension system in the washing machine for a predefined period of time.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION OF THE INVENTION

An out-of-balance load/condition (e.g., an unbalanced load) can arise during any spin cycle as a basket within a washing machine is rotated about a spin axis at a relatively high spin speed to extract moisture from articles in a basket. In the case of a top-loading washing machine, such spin axis may be generally situated in a substantially vertical plane whereas in a front-loading washing machine such spin axis may be generally situated in a substantially horizontal plane. However, in the context of a vertical axis washing machine, articles may asymmetrically bunch up at various height locations in the basket due to a resulting load unbalance in combination with a centrifugal force generated during a spin cycle. As a result, the washing machine may vibrate uncontrollably imposing undue stress force on various components of the washing machine, which wastes energy and creates unwanted sound.

Figure 1:
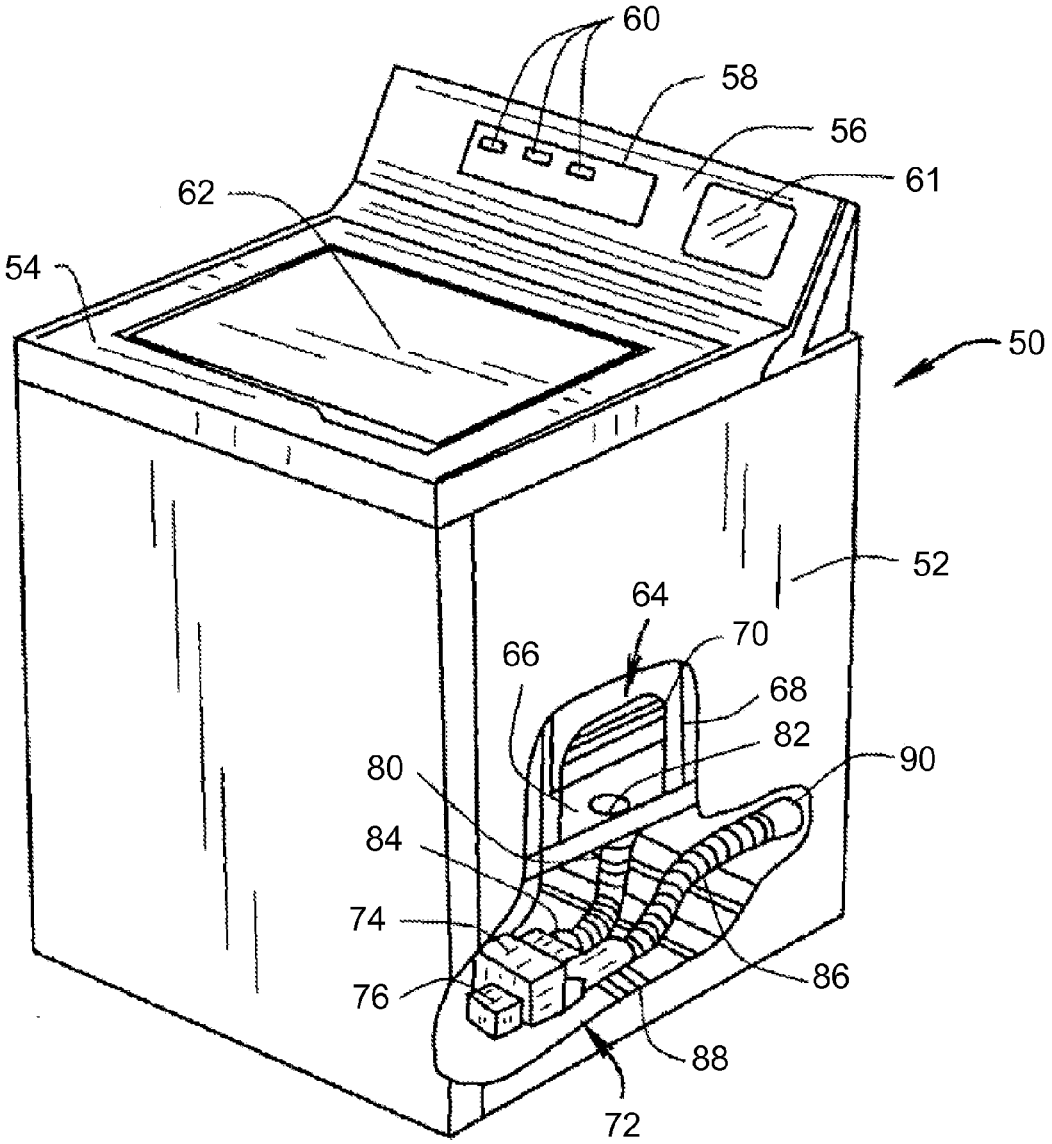
FIG. 1 is a perspective cutaway view of an exemplary washing machine.

FIG. 1 is a perspective cutaway view of an exemplary washing machine 50. While embodiments of the disclosure are illustrated and described herein with reference to washing machine 50 being a vertical axis washing machine, aspects of the disclosure are operable with any device that performs the functionality illustrated and described herein, or its equivalent.

Washing machine 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface enabling a user to select washing machine cycles and features. In one embodiment, a display 61 indicates selected features, a countdown timer, and other items of interest to washing machine users. In a further embodiment, display 61 may be, for example, a capacitive touch screen display. User input functionality may be provided in display 61 which acts as a user input selection device, in conjunction with, or in place of input selectors 60. Display 61 may be configured to be responsive to a user contacting display 61 to selectively perform functionality of washing machine 50. Thus, a user can select, for example, washing machine cycles by contacting a surface of display 61 as well as other functions provided herein.

Washing machine 50 further includes a lid 62 mounted to cover 54 that is rotatable about a hinge (not shown) from an open position (not shown) that facilitates access to a wash tub 64 located within cabinet 52, to a closed position that prevents access to wash tub 64. Wash tub 64 includes a bottom wall 66, a sidewall 68, and a basket 70 that is rotatably mounted within wash tub 64. A pump assembly 72 is located beneath wash tub 64 and basket 70 for gravity assisted flow when draining wash tub 64. Pump assembly 72 includes a pump 74 and a motor 76. A pump inlet hose 80 extends from a wash tub outlet 82 in bottom wall 66 to a pump inlet 84, and a pump outlet hose 86 extends from a pump outlet 88 to an appliance washing machine water outlet 90.

Figure 2:
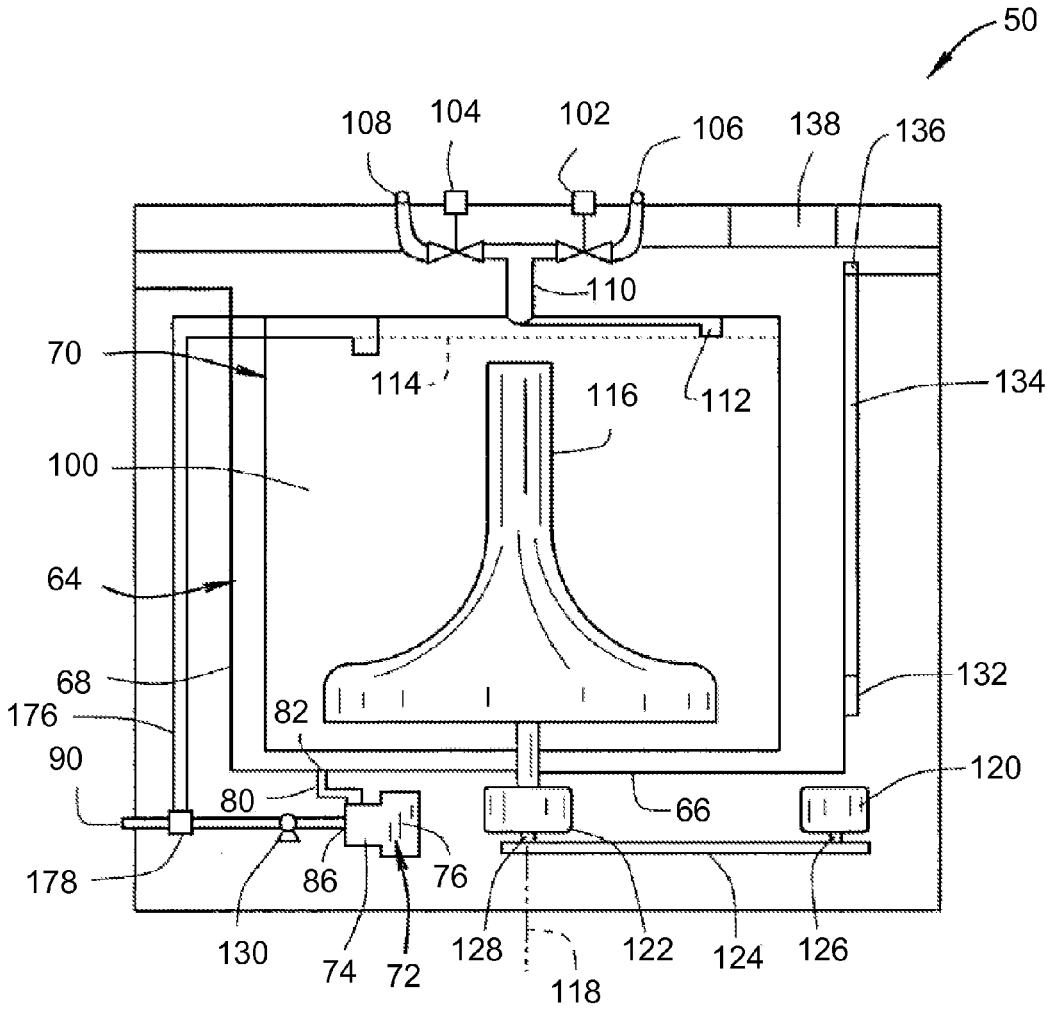
FIG. 2 is front schematic view of the washing machine shown in FIG. 1.

FIG. 2 is a front elevational schematic view of washing machine 50. As shown in FIG. 2, basket 70 is rotatably mounted in wash tub 64 in a spaced apart relationship from side wall 68 and bottom wall 66. Basket 70 includes a plurality of perforations therein to facilitate fluid communication between an interior of basket 70 and wash tub 64. A hot liquid valve 102 and a cold liquid valve 104 deliver fluid (e.g., water) to basket 70 and wash tub 64 through a hot liquid hose 106 and a cold liquid hose 108, respectively. Valves 102 and 104, and hoses 106 and 108 together form a liquid supply connection for washing machine 50 and, when connected to a building plumbing system (not shown), provide a fresh water supply for use in washing machine 50. Valves 102 and 104, and hoses 106 and 108 are connected to a basket inlet tube 110, and water flows from basket inlet tube 110 through nozzle assembly 112 into basket 70. A known dispenser (not shown in FIG. 2), may also be provided to supply a wash solution by mixing fresh water with a detergent or other composition for cleansing of articles in basket 70.

In an alternative embodiment, a known spray fill conduit 114 (shown in phantom in FIG. 2) is employed in lieu of nozzle assembly 112. Spray fill conduit 114 includes a plurality of openings along its length that are arranged in a predetermined pattern to direct incoming streams of water towards articles in basket 70. The openings in spray fill conduit 114 are spaced sufficiently from each other to produce an overlapping coverage of liquid streams into basket 70. Articles in basket 70 may therefore be uniformly wetted even when basket 70 is maintained in a stationary position.

A known agitation element 116, such as a vane agitator, impeller, auger, oscillatory basket mechanism, or some combination thereof is disposed in basket 70 to impart an oscillatory motion to articles and liquid in basket 70. In other embodiments, agitation element 116 may be a single action element (e.g., oscillatory only), a double action element (e.g., oscillatory movement at one end, single direction rotation at the other end) or a triple action element (e.g., oscillatory movement plus single direction rotation at one end, singe direction rotation at the other end). As illustrated in FIG. 2, agitation element 116 is oriented to rotate about a vertical axis 118.

Basket 70 and agitator 116 are driven by a drive and motor assembly 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Drive and motor assembly 120, transmission and clutch system 122, and belt 124 collectively are referred to herein as a washing machine drive system.

Washing machine 50 may also include a brake assembly (not shown) that can be applied to maintain basket 70 in a stationary position within wash tub 64 or released to allow basket 70 to spin within wash tub 64. In one embodiment, pump assembly 72 is activated to remove liquid from basket 70 and wash tub 64 through drain outlet 90 and a drain valve 130 during appropriate times in washing cycles as washing machine 50 is used. In one embodiment, washing machine 50 also includes a reservoir 132, a tube 134 and a pressure sensor 136. As water levels rise in wash tub 64, air is trapped in reservoir 132 creating pressure in tube 134 that is monitored by pressure sensor 136. Liquid levels (e.g., water levels), and more specifically, changes in liquid levels in wash tub 64 may therefore be sensed, for example, to indicate laundry loads and to facilitate associated control decisions. In further embodiments, load size and cycle effectiveness are determined or evaluated using other known indicia, such as motor spin, torque, load weight, motor current, and voltage or current phase shifts.

Operation of washing machine 50 is controlled by a controller 138 which is operatively coupled to the user interface input located on washing machine backsplash 56 to enable a user to select washing machine cycles and features. In response to a selection by the user via input selectors 60, controller 138 operates various components of washing machine 50 to execute selected machine cycles and features. One of ordinary skill in the art guided by the teachings herein will appreciate that controller 138 may be used to control washing machine system elements and to execute functions beyond those specifically described herein.

As mentioned above, an out-of-balance load/condition can arise during any spin cycle as basket 70 is rotated about a spin axis at a relatively high spin speed to extract moisture from articles in basket 70. In the case of a top-loading washing machine, such spin axis may be generally situated in a substantially vertical plane whereas in a front-loading washing machine such spin axis may be generally situated in a substantially horizontal plane. However, in the context of a vertical axis washing machine (e.g., washing machine 50), articles may asymmetrically bunch up at various height locations in basket 70 and due to a resulting load unbalance in combination with a centrifugal force generated during a spin cycle, wash tub 64 may vibrate uncontrollably so as to strike cabinet 52 as well as to impose undue stress force on various components of washing machine 50 such as a transmission, a suspension, and other such washing machine components. Unwanted levels of vibrations not only impose undue stress and damage, but also waste energy and create unwanted sound.

Figure 3:
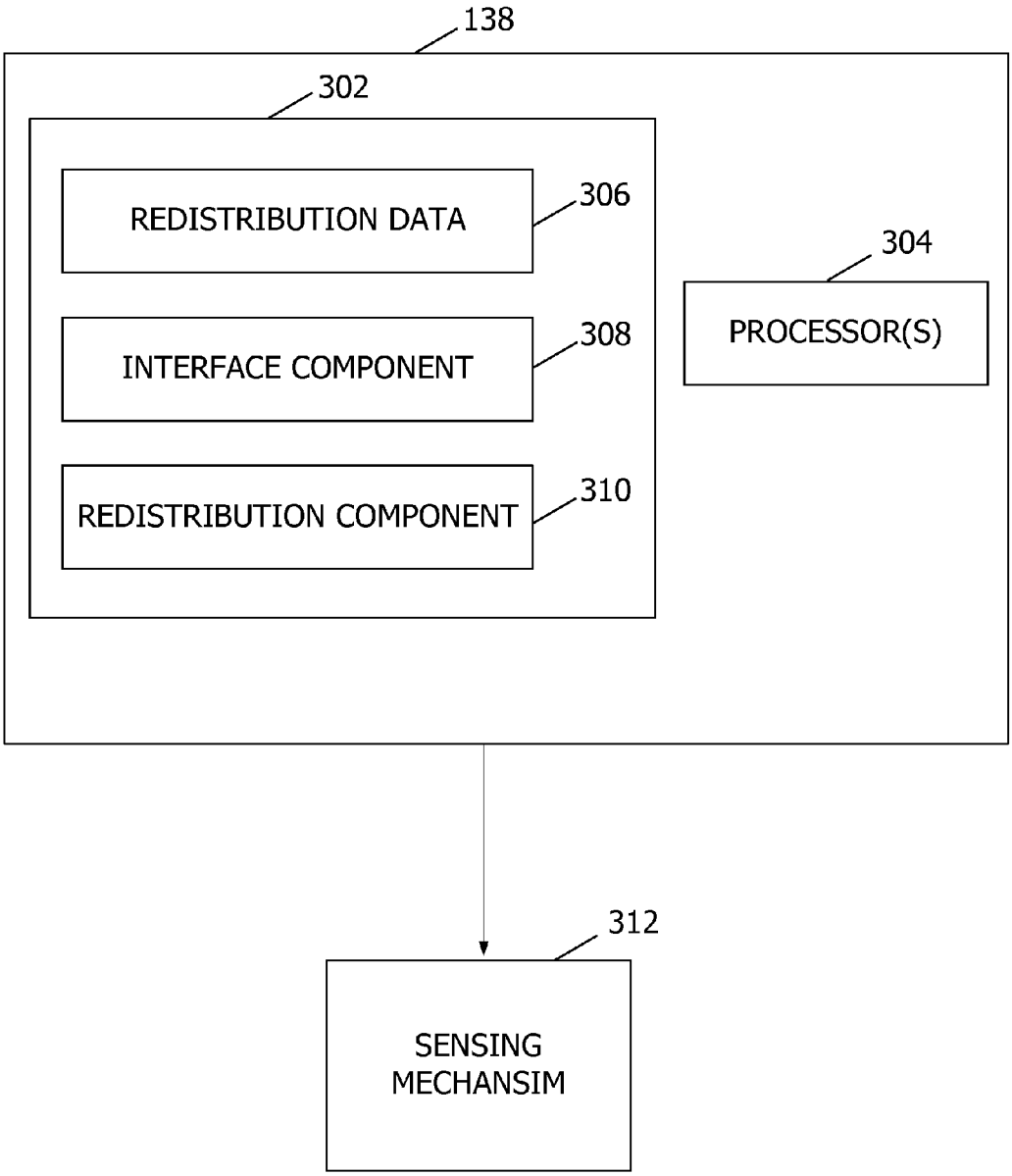
FIG. 3 is a schematic block diagram of a controller for the washing machine shown in FIGS. 1 and 2.

FIG. 3 is a schematic block diagram of controller 138. Referring now to FIGS. 1, 2, and 3, in one embodiment, controller 138 is communicatively coupled to sensing mechanism 312 configured to detect an unbalanced load in washing machine 50 based on a spin speed of basket 70 and a natural frequency of a suspension system (e.g., wash tub 64, basket 70, and drive and motor assembly 120) in washing machine 50. A natural frequency of the suspension system in washing machine 50 occurs at a rotational speed where wash tub 64 tends to oscillate with larger amplitudes within the washing machine 50. Vibrations of washing machine 50 strengthen as a natural frequency of the suspension system in washing machine 50 is approached and vibrations of washing machine 50 weaken as a distance from the natural frequency of the suspension system in washing machine 50 is increased. For illustrative purposes, a natural frequency may be shown with respect to a bell curve. As such, on either side of a natural frequency (which is on top of the bell curve) in a natural frequency bell curve, vibrations are at a lower amplitude and are thus less than vibrations at the natural frequency, which is at a higher amplitude. In one embodiment, since natural frequencies vary from machine to machine, and are also changed by, for example, a size of load in a washing machine, a natural frequency of the suspension system that includes a large load in basket 70, may not be the same as a natural frequency of the suspension system that includes a small load in basket 70.

An unbalanced load may be detected as a spin speed of basket 70 approaches a critical spin speed (e.g., a spin speed that excites a natural frequency) or once a critical spin speed is reached. Thus, if a critical spin speed of basket 70 is 250 rpm, the closer a spin speed of basket 70 is to 250 rpm, the more vibrations increase. As described in greater detail below, controller 138 is configured to limit a spin speed of basket 70 so that a natural frequency of the suspension system in washing machine 70 is not reached.

Controller 138 has a memory area 302 and at least one processor 304. Memory area 302 stores components for balancing an unbalanced load in washing machine 50. For example, memory area 302 stores instructions, calibration constants, elements of selected washing cycles, user defined settings, redistribution data 306, as well as one or more computer-executable components. Exemplary components include, but are not limited to an interface component 308, and redistribution component 310. While components 308 and 310 are shown to be stored in memory area 302, components 308 and 310 may be stored and executed from a memory area remote from controller 138. For example, redistribution data 306 may be stored in a cloud service, a database, or other memory area accessible by controller 138. Such embodiments reduce the computational and storage burden on controller 138.

Processor 304 executes computer-executable instructions for implementing aspects of the disclosure. In general, processor 304 may be programmed with instructions such as described herein with reference to the components illustrated in FIG. 3, and the operations illustrated and next described in FIG. 4. In some embodiments, processor 304 is transformed into a special purpose microprocessor by executing computer-executable instructions or by otherwise being programmed. For example, processor 304 may execute interface component 308 and redistribution component 310. Interface component 308, when executed by processor 304, causes processor 304 to receive an identification from, for example, sensing mechanism 312 that an unbalanced load in washing machine 50 has been detected during a spin cycle prior to a spin speed of basket 70 reaching a target spin speed. Redistribution component 310, when executed by processor 304, causes processor 304 to limit the spin speed of basket 70 to a spin speed lower than the natural frequency of the suspension system in washing machine 50 for a predefined period of time. For example, if a natural frequency is 250 rpm, and as a spin speed of basket 70 approaches the natural frequency of 250 rpm, an unbalance load is detected and the spin speed of basket 70 may be limited or stopped at an acceptable level (e.g., a level that does not produce a level of unwanted vibration). Further, with respect to the predefined period of time a limited spin speed is executed, the predefined period of time may be a remainder of time for a current spin cycle. That is, a spin cycle time is not changed by limiting a spin speed. Therefore, the predefined period of time may be equivalent to a standard spin time and thus may be dependent on user defined settings. In one embodiment, a predefined period of time may be a period of time set by a manufacturer that is greater than a standard spin time. In a further embodiment, after the predefined period of time, the spin speed of basket 70 is increased to the target spin speed.

In some embodiments, redistribution component 310, when executed by processor 304, causes processor 304 to determine a quantity of previous out-of-balance load redistribution attempts, compare the determined quantity of previous out-of-balance load redistribution attempts to a redistribution attempt threshold level, and if the determined quantity of previous out-of-balance load redistribution attempts has exceeded the redistribution attempt threshold level, limit the spin speed of basket 70 to a spin speed lower than the natural frequency of the suspension system in washing machine 50 for a predefined period of time. If, however, the determined quantity of previous out-of-balance load redistribution attempts has not exceeded the redistribution attempt threshold level, the redistribution component further causes the at least one processor to initiate an out-of-balance load redistribution by executing one or more of the following: limit a spin speed of basket 70, execute a redistribution fill by adding a quantity of water to wash tub 64, perform a redistribution agitation after executing the redistributing fill, and execute an alpha wash, each of which are described in further detail below.

The detection of the unbalanced load may occur at any stage in a washing cycle. For example, sensing mechanism 312 may detect an unbalance load during any spin cycle, whether it be a first spin cycle, a second spin cycle, or even a final spin cycle. As mentioned above, with respect to the predefined period of time a limited spin speed is executed, the predefined period of time may be a period of time in addition to current spin cycle time. That is, a spin cycle time is changed by an amount equal to the period of time the spin speed is limited. In one embodiment, a limited spin speed may be a predefined spin speed, for example, a spin speed that is lower than, but not based on a natural frequency. Therefore, a spin speed may be limited to, for example, 150 rpm, if the natural frequency is 200 rpm, 250 rpm, or even 275 rpm. In a further embodiment, a limited spin speed may change with respect to the natural frequency. Thus, the higher a natural frequency, the higher a limited spin speed, and alternatively, the lower a natural frequency, the lower a limited spin speed.

With continued reference to FIG. 3, after an identification of an out-of-balance load during a final spin cycle, redistribution component 310, when executed by processor 304, may cause processor 304 to execute an out-of-balance load redistribution by executing one or more of the following: limit a spin speed of basket 70, execute a redistribution fill by adding a quantity of water to wash tub 64, perform a redistribution agitation after executing the redistributing fill, and execute an alpha wash. In one embodiment, a redistribution fill may be executed by either adding a maximum quantity of water in wash tub 64, or by adding in a quantity of water equivalent to an initial wash fill selected by a user. After the redistribution fill is executed, the water may then been drained from wash tub 64, or a redistribution agitation may be executed by agitating articles in basket 70 for a predefined period of time. In some embodiments, the predefined period of time for executing a redistribution agitation is shorter, equal to, or longer than a period of time to execute a standard agitation. Further, an alpha wash may be executed by spinning basket 70 for period of time less than, equal to, or greater than a previous spin cycle time while a predefined quantity of water is in wash tub 64. In one embodiment, the spin speed of basket 70 during the alpha wash is lower than the natural frequency of the suspension system in washing machine 70.

Figure 4:
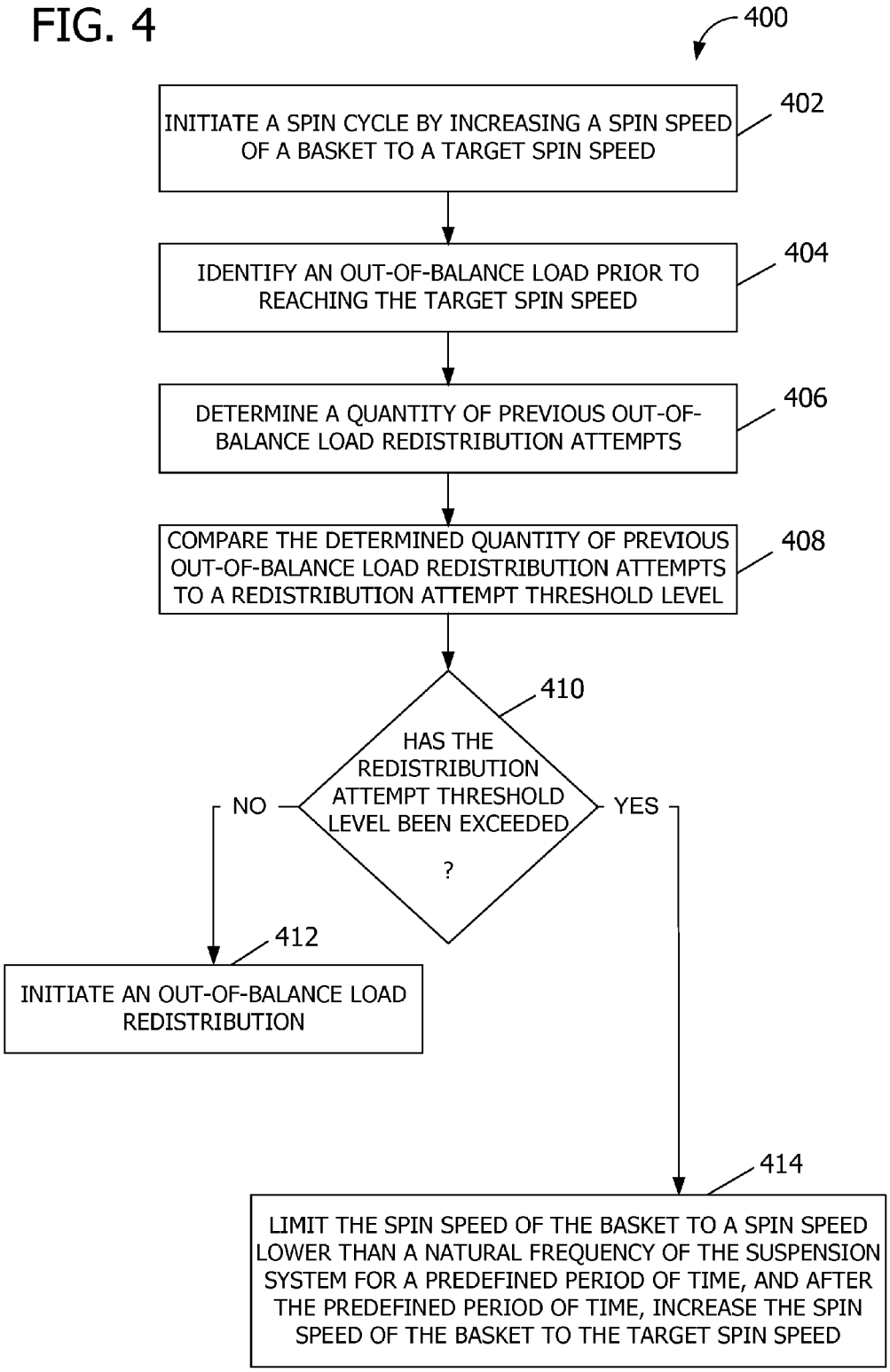
FIG. 4 is a diagram illustrating a process for balancing an unbalanced load in a washing machine.

FIG. 4, is an exemplary flow chart illustrating a process 400 for balancing an unbalanced load in washing machine 50. The process includes initiating a spin cycle at 402 by increasing a spin speed of basket 70 in washing machine 50 to a target spin speed, for example, a highest spin speed achieved during the spin cycle. The target spin speed may be established by either a user or a manufacturer. In some embodiments, the target spin speed is between about 700 rpm to about 775 rpm. At 404, an out-of-balance load is identified prior to basket 70 reaching the target spin speed. In one embodiment, sensing mechanism 312 is a prediction filter that can determine that a load is out-of-balance prior to the spin speed of basket 70 reaching the natural frequency of the suspension system of washing machine 50. In a further embodiment, sensing mechanism 312 is a reaction filter that can determine that a load is out-of-balance when the spin speed of basket 70 reaches the natural frequency of the suspension system of washing machine 50. Once an out-of-balance condition has been identified, a redistribution of the unbalanced load may be initiated. In some embodiments, only a predefined quantity of redistribution attempts may be executed per spin cycle and/or per washing cycle. Thus, before a redistribution of the unbalanced load is initiated, at 406, redistribution data 306 is accessed to determine a quantity of previous out-of-balance load redistribution attempts. A redistribution attempt threshold level (e.g., ranging from 1-8 redistribution attempts) may be accessed from, for example, the redistribution data. In one embodiment, the redistribution attempt threshold level is set by a user. In a further embodiment, the redistribution attempt threshold level is set by a manufacturer. At 408, the determined quantity of previous out-of-balance load redistribution attempts is compared to the redistribution attempt threshold level.

At 410, if the determined quantity of previous out-of-balance load redistribution attempts has not exceeded the redistribution attempt threshold level, an out-of-balance load redistribution is initiated at 412. If, however, the determined quantity of previous out-of-balance load redistribution attempts has exceeded the redistribution attempt threshold level, at 414, the spin speed of basket 70 is limited to a spin speed lower than the natural frequency of the suspension system of washing machine 50 for a remainder of the spin cycle. In one embodiment, the spin speed of basket 70 is limited to a spin speed lower than the natural frequency of the suspension system of washing machine 50 for a predefined period of time (e.g., five minutes), and after the predefined period of time, the spin speed of the basket is increased to the target spin speed for the remaining duration of the spin cycle. In some embodiments, upon increasing the spin speed of basket 70 to the target spin speed, if an out-of-balance condition is once again detected, the spin speed of basket 70 is again limited to a spin speed lower than the natural frequency of the suspension system of washing machine 50 for a predefined period of time, and the process is repeated until an out-of-balance condition is not detected, or until a limit spin speed attempt threshold level is exceeded. Similar to the redistribution attempt threshold level, the limit spin speed attempt threshold level may be set by a user or a manufacturer.

Figure 5:
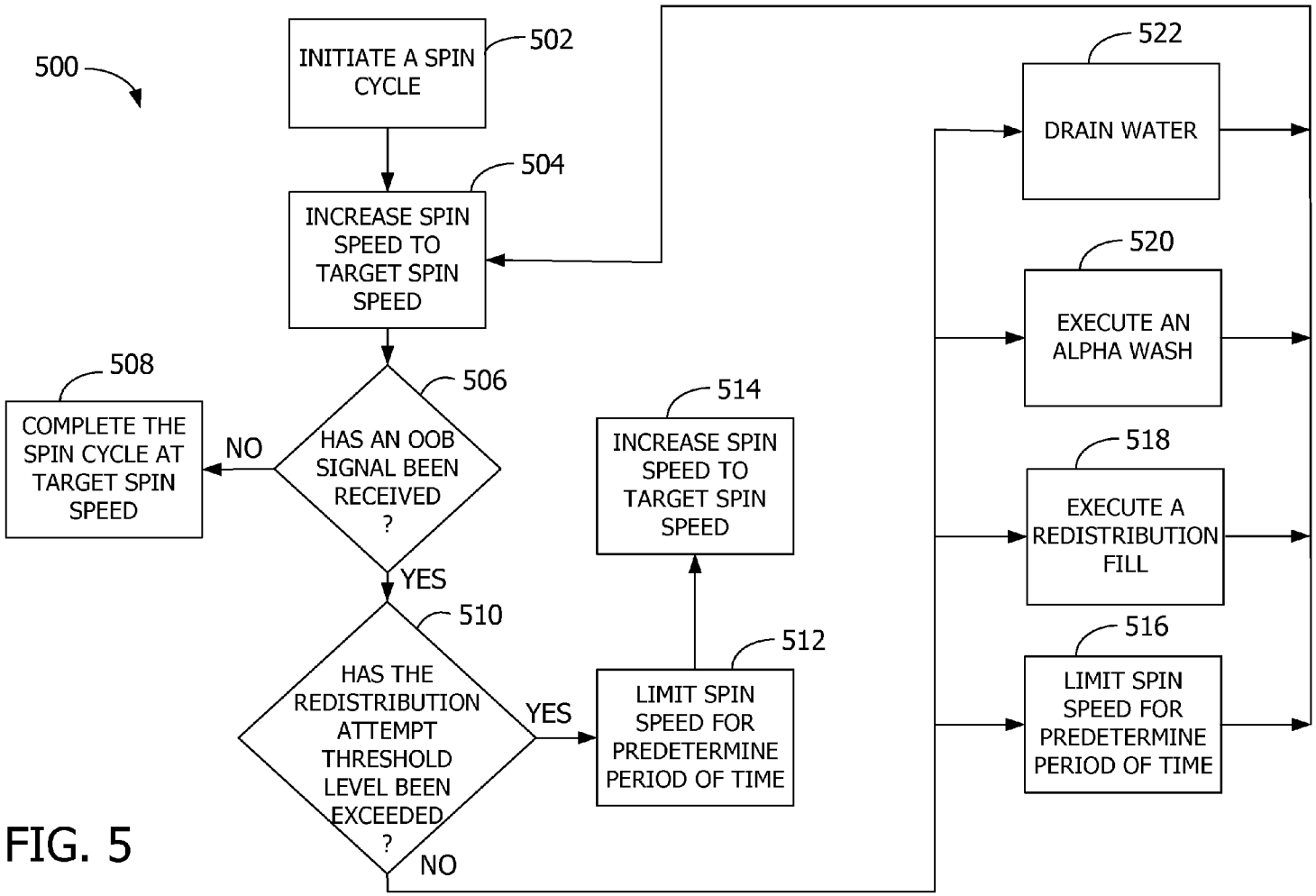
FIG. 5 is a diagram illustrating a process for balancing an unbalanced load in a washing machine.

FIG. 5 is an exemplary flow chart illustrating a process 500 for balancing an unbalanced load in washing machine 50 (FIGS. 1 and 2). With reference to FIGS. 1, 2, 3, and 5, at 502, a spin cycle is initiated. The initiated spin cycle shown in FIG. 5 may be any one of a number of spin cycles executed during a washing cycle. For example, the initiated spin cycle may be the first spin cycle, the third spin cycle, the fifth spin cycle, or the final spin cycle. Thus, the remainder of the disclosure will discuss an operation of process 500 in terms of and with respect to "a" or "the" spin cycle, which is representative of any spin cycle executed on a washing machine.

At 504, a spin speed of basket 70 begins to increase to a target spin speed. As basket 70 increases, a signal indicative of an out-of-balance condition (e.g., an unbalanced load) may be received from, for example, sensing mechanism 312. If, at 506, it is determined that a signal indicative of an out-of-balance condition is not received, at 508, the spin cycle is completed under normal operating conditions (e.g., at a target spin speed) the washing cycle continues. If, however, at 506 it is determined that a signal indicative of an out-of-balance condition from sensing mechanism 312 is received, a redistribution of the unbalanced load (represented by the out-of-balance condition) is executed. In one embodiment, executing a redistribution of the unbalance load may include one or more of the following: limit a spin speed of basket to a predefined spin speed fore predefined period of time; execute a redistribution fill, which may be followed by a redistribution agitate; and, execute a redistribution alpha, which may also be followed by a redistribution agitate.

In some embodiments, at 510, it is determined whether a redistribution attempt threshold level has been exceeded. In one embodiment, user may select a number of redistribution attempts allowed (e.g., the user may select the redistribution attempt threshold level). In a further embodiment, the redistribution attempt threshold level may be set by a manufacturer. If, at 510, the number of redistribution attempts has exceeded the redistribution attempt threshold level, at 512, the spin speed of basket 70 is limited to a predefined spin speed that is lower than the natural frequency of the suspension system of washing machine 50, and the spin cycle is completed at the limited spin speed. Alternatively, basket 70 is limited to a predefined spin speed for a predefined period of time, and at 514, after the predefined period of time, the spin speed begins to increase to the target spin speed once again. In some embodiments, if an out-of-balance condition is once again detected, the spin speed of basket 70 is again limited to a spin speed lower than the natural frequency of the suspension system of washing machine 50 for a predefined period of time prior to the spin speed of basket 70 reaching the target spin speed, and the process is repeated until an out-of-balance condition is not detected, or until a limit spin speed attempt threshold level is exceeded.

If, however, at 510, the number of redistribution attempts has not exceeded the redistribution attempt threshold level, a redistribution attempt including one or more of the following actions may occur: at 516, the spin speed of basket 70 is limited to a predefined spin speed fore predefined period of time; at 518, a redistribution fill is executed, which may be followed by a redistribution agitate; and, at 520, a redistribution alpha is executed, which may also be followed by a redistribution agitate. Further, following any one 516-

520, water may be drained from wash tub 64 at 522. In one embodiment, any one of 516-522 may also be repeated in a redistribution attempt. Thus, after a completion the redistribution attempt, the process continues to 504 where the spin speed of basket 70 begins to increase to the target spin. In some embodiments, the process shown in FIG. 5 continues until an unbalanced load is not detected, regardless of the number of redistribution attempts.

Exemplary Operating Environment

A controller or computing device such as is described herein has one or more processors or processing units, system memory, and some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules or other data. Communication media typically embody computer readable instructions, data structures, program modules, or other data in a modulated data signal, such as a carrier wave or other transport mechanism, and include any information delivery media. Combinations of any of the above are also included within the scope of computer readable media.

The controller/computer may operate in a networked environment using logical connections to one or more remote computers, such as a remote computer. Although described in connection with an exemplary computing system environment, embodiments of the present disclosure are operational with numerous other general purpose or special purpose computing system environments or configurations. The computing system environment is not intended to suggest any limitation as to the scope of use or functionality of any aspect of the present disclosure. Moreover, the computing system environment should not be interpreted as having any dependency or requirement relating to any one or combination of components illustrated in the exemplary operating environment. Examples of well known computing systems, environments, and/or configurations that may be suitable for use with aspects of the present disclosure include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the present disclosure may be described in the general context of computer-executable instructions, such as program modules, executed by one or more computers or other devices. The computer-executable instructions may be organized into one or more computer-executable components or modules. Generally, program modules include, but are not limited to, routines, programs, objects, components, and data structures that perform particular tasks or implement particular abstract data types. Aspects of the present disclosure may be implemented with any number and organization of such components or modules. For example, aspects of the present disclosure are not limited to the specific computer-executable instructions or the specific components or modules illustrated in the figures and described herein. Other embodiments of the present disclosure may include different computer-executable instructions or components having more or less functionality than illustrated and described herein. Aspects of the present disclosure may also be practiced in distributed computing environments where tasks are performed by remote processing devices that are linked through a communications network. In a distributed computing environment, program modules may be located in both local and remote computer storage media including memory storage devices.

Aspects of the present disclosure transform a general-purpose computer into a special-purpose computing device when configured to execute the instructions described herein.

The order of execution or performance of the operations in embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

When introducing elements of aspects of the present disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

This written description uses examples to disclose the claimed subject matter, including the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A washing machine comprising:

a suspension system comprising a wash tub, a basket rotatably coupled within the wash tub and configured to receive a laundry load having a load size, and a drive and motor assembly, the suspension system defining a natural frequency that varies relative to the load size;

a sensing mechanism configured to detect an unbalanced load in the washing machine based in part on the natural frequency of the suspension system relative to the load size; and a controller programmed to:

determine the natural frequency of the suspension system based on the particular suspension system and the size of the load;

initiate a spin cycle by increasing a spin speed of the basket to a target spin speed;

communicate with the sensing mechanism;

when an unbalanced load is detected by the sensing mechanism identify an out-of-balance load prior to reaching the target spin speed;

determine if a quantity of previous out-of-balance load redistribution attempts exceeds a redistribution attempt threshold level;

initiate an out-of-balance load redistribution if the quantity of previous out-of-balance load redistribution attempts has not exceeded the redistribution attempt threshold level;

increase the spin speed of the basket to the target spin speed after the out-of-balance load redistribution;

detect if the laundry load is out-of-balance with the sensing mechanism after increasing the spin speed of the basket; and if the determined quantity of previous out-of-balance load redistribution attempts has exceeded the redistribution attempt threshold level, limit the spin speed of the basket to a limited spin speed lower than and based on the determined natural frequency of the suspension system corresponding to the load size for a predefined period of time.

2. A washing machine in accordance with claim 1, wherein determining if the quantity of previous out-of-balance load redistribution attempts exceeds the redistribution attempt threshold level comprises:

determining the quantity of previous out-of-balance load redistribution attempts; and comparing the determined quantity of previous out-of-balance load redistribution attempts to a redistribution attempt threshold level.

3. A washing machine in accordance with claim 1, wherein the out-of-balance load redistribution comprises at least one of the following:

(i) limiting the spin speed of the basket to a spin speed lower than a natural frequency of the suspension system for a predefined period of time, and after the predefined period of time, increase the spin speed of the basket to the target spin speed;

(ii) executing a redistribution fill by adding a quantity of water to the wash tub and draining the quantity of water from the wash tub;

(iii) performing a redistribution agitation for a predefined period of time; and (iv) adding a predefined quantity of water to the wash tub, and rotating the basket at a spin speed lower than the natural frequency of the suspension system.

4. A washing machine in accordance with claim 3, wherein the quantity of water is based on a user defined setting.

5. A washing machine in accordance with claim 3, wherein the quantity of water is a maximum quantity of water.

6. A washing machine in accordance with claim 1, wherein the controller is further configured to initiate an out-of-balance load redistribution comprising adding a predefined quantity of water to the wash tub, and rotating the basket at a spin speed lower than the natural frequency of the suspension system corresponding to the load size.

7. A washing machine in accordance with claim 1, wherein after limiting the spin speed of the basket to a spin speed lower than a natural frequency of the suspension system for a predefined period of time, the controller is further configured to increase the spin speed of the basket to the target spin speed.

8. A washing machine in accordance with claim 1, wherein the sensing mechanism is further configured to measure the spin speed of the basket.

9. A washing machine in accordance with claim 1, wherein the detecting of the unbalanced load in the washing machine is further based in part on the spin speed of the basket.

10. A washing machine in accordance with claim 1, wherein the predefined period of time is greater than a standard spin time.

* * * * *